US006392630B1

(12) United States Patent
Lin et al.

(10) Patent No.: US 6,392,630 B1
(45) Date of Patent: May 21, 2002

(54) COMPENSATION CIRCUIT FOR A LIQUID CRYSTAL DISPLAY

(75) Inventors: Tien-jen Lin; Hsin-hung Chen, both of Tainan (TW)

(73) Assignee: Chi Mei Optoelectronics Corp. (TW)

( * ) Notice: Subject to any disclaimer, the term of this patent is extended or adjusted under 35 U.S.C. 154(b) by 0 days.

(21) Appl. No.: 09/566,299

(22) Filed: May 5, 2000

(30) Foreign Application Priority Data

Feb. 23, 2000 (TW) ..... 89103206 A

(51) Int. Cl.[7] ..... G09G 3/36
(52) U.S. Cl. ..... 345/98; 345/100
(58) Field of Search ..... 345/87, 92, 90, 345/98, 100, 58, 55; 348/792, 793, 634, 635; 349/33, 34, 37, 38, 39

(56) References Cited

U.S. PATENT DOCUMENTS 5,739,804 A * 4/1998 Okumura et al. ..... 345/100
5,748,169 A * 5/1998 Okumura et al. ..... 345/98
6,229,512 B1 * 5/2001 Shigehiro ..... 345/98
6,292,162 B1 * 9/2001 Shiki ..... 345/98

* cited by examiner

*Primary Examiner*—Chanh Nguyen
(74) *Attorney, Agent, or Firm*—Martine & Penilla, LLP

(57) ABSTRACT

A compensation circuit is provided to remove the flicker occurring on the panel of a liquid crystal display by adjusting the data signal applied to each pixel. The compensation circuit mainly includes: a memory device, a buffer, a digital/analog converter and a data signal line driving circuit. The memory device stores a plurality of digital compensation data wherein each is used as the compensation signal for a pixel of the LCD. The buffer is connected to the memory device for temporarily storing the compensation data coming from the memory device in response to a first clock. The digital/analog converter is connected to the buffer for converting the digital data coming from the buffer into an analog data in response to a second clock. The data signal line driving circuit consists of n (the number of pixels on each scan line) units each is composed of a sample/hold circuit unit and an output circuit unit. Each sample/hold circuit unit receives an analog data coming from the digital/analog converter or a ground potential, samples the received data and holds the sampled result. Each output circuit unit receives the output data coming from the corresponding sample/hold circuit unit and an external signal, outputs the summed result of the two received data to a corresponding pixel. When flicker compensation is to be performed, each sample/hold circuit unit receives an analog compensation data coming from the digital/analog converter. On the other hand, when flicker compensation is not to be performed, each sample/hold circuit unit receives a ground potential.

5 Claims, 6 Drawing Sheets

COMPENSATION CIRCUIT FOR A LIQUID CRYSTAL DISPLAY

BACKGROUND OF THE INVENTION

A. Field of the Invention

The present invention relates to a compensation circuit for a liquid crystal display, especially to a compensation circuit which can remove the flicker occurring on the panel of a liquid crystal display by providing a compensation signal for each pixel of the liquid crystal display.

B. Description of the Prior Art

Referring to FIG. 5(A), it shows the structure of a conventional active matrix liquid crystal display (LCD). The liquid crystal display mainly includes a pixel array 51, a data signal line driving circuit 52, and a scan signal line driving circuit 53. The pixel array 51 includes a plurality of pixels. A thin film transistor (TR) drives each pixel 54. The source of each thin film transistor (TR) is connected to a common voltage $V_{com}$ via a liquid crystal capacitor $C_{lc}$, and connected to a saturation voltage $V_{st}$ via a storage capacitor $C_{st}$. Parasitic capacitance $C_{gs}$ exists between the source and the gate. Moreover, distributed resistance-capacitance (R-C) indispensably exists on each scan signal line SL, which can be represented by a plurality of $R_d$ and $C_d$ distributed in each pixel as illustrated in FIG. 5(A). If the storage capacitor $C_{st}$ is connected to the common voltage $V_{com}$, then the circuit can be simplified as illustrated in FIG. 5(B).

As described above, due to the existence of the distributed RC on each scan signal line SL, the scan pulse generated by the scan signal line driving circuit 53 is subject to distortion more and more severely from left side to right side when it reaches a pixel on the same scan signal line SL (with reference to FIG. 5(A), the left side represents the side of the scan signal line driving circuit 53). The distortion of the scan pulse can be illustrated more clearly by FIGS. 6(A) and 6(B). When a scan pulse is generated by the scan signal line driving circuit 53 and transmitted to a scan signal line SL, the waveform as illustrated in FIG. 6A represents the signal applied to the gate of the leftmost pixel transistor, the waveform as illustrated in FIG. 6B represents the signal applied to the gate of the rightmost pixel transistor. For instance, take a 14.1 inch LCD with resolution of 1024×768 for an example. It takes only a few nanoseconds for the waveform of FIG. 6A to rise from low to high. However, it takes a few microseconds for the waveform of FIG. 6B to rise from low to high.

Referring to FIG. 5(B), due to the existence of the parasitic capacitance $C_{gs}$, the potential of the source will be pulled down by the signal applied to the gate of the thin film transistor (TR) via the parasitic capacitance $C_{gs}$. Such effect will become less and less apparent for the pixel transistors from left side to right side on the same scan signal line SL. In other words, when the drain of each pixel transistor on the same scan signal line is provided with the same data signal, the potential on the source of each pixel transistor is getting higher and higher from left side to right side. Since the brightness of each pixel is determined by the voltage applied to the equivalent capacitance $C_{lc}+C_{st}$, the resulting brightness of each pixel will therefore be different. This result is undesirable because the brightnesses of two pixels are supposed to be the same if they are provided with the same potential. The inconsistency of the pixel brightness will cause flicker on the LCD.

SUMMARY OF THE INVENTION

Accordingly, it is an object of the present invention to provide a compensation circuit for a liquid crystal display, thereby removes the flicker by adjusting the potential applied to each pixel. Eventually, when the active element of each pixel on the same scan signal line is provided with the same data signals, the potential on each pixel and the brightness of each pixel will be the same.

It is another object of the present invention to provide a compensation circuit for a liquid crystal display which has the merits of simple structure and low cost. Moreover, the compensation circuit in accordance with the present invention can be selectively enabled or disabled according to practical applications.

In accordance with the present invention, the compensation circuit mainly includes: a memory device, a buffer, a digital/analog converter and a data signal line driving circuit. The memory device stores a plurality of digital data set each of which corresponds to the pixel array on a scan line. Each digital data set has length n which is equal to the length of a pixel array. Each of the n digital data is used as the compensation signal of a pixel on the pixel array. The buffer is connected to the memory device for temporarily store a digital data set coming from the memory device in response to an external clock CK1. The digital/analog converter is connected to the buffer for converting the digital data set coming from the buffer into an analog data set in response to an external clock CK2. The data signal line driving circuit, consisting of n units each of which is composed of a sample/hold circuit unit and an output circuit unit, provides adequate data signals for the n pixels of each pixel array. Each of the sample/hold circuit units receives an analog data of the analog data set coming from the digital/analog converter or a ground potential, samples the received data and holds the sampled result. Each of the output circuit units receives the output data coming from the corresponding sample/hold circuit unit and an external signal, outputs the summed result of the two received data to a corresponding pixel.

When flicker is to be compensated, each sample/hold circuit unit receives an analog data of the analog data set coming from the digital/analog converter. On the other hand, when flicker is not to be compensated, each sample/hold circuit unit receives a ground potential.

BRIEF DESCRIPTION OF THE DRAWINGS

These and other objects and advantages of the present invention will become apparent by reference to the following description and accompanying drawings wherein.

DETAILED DESCRIPTION OF THE PREFERRED EMBODIMENTS

Figure 1:
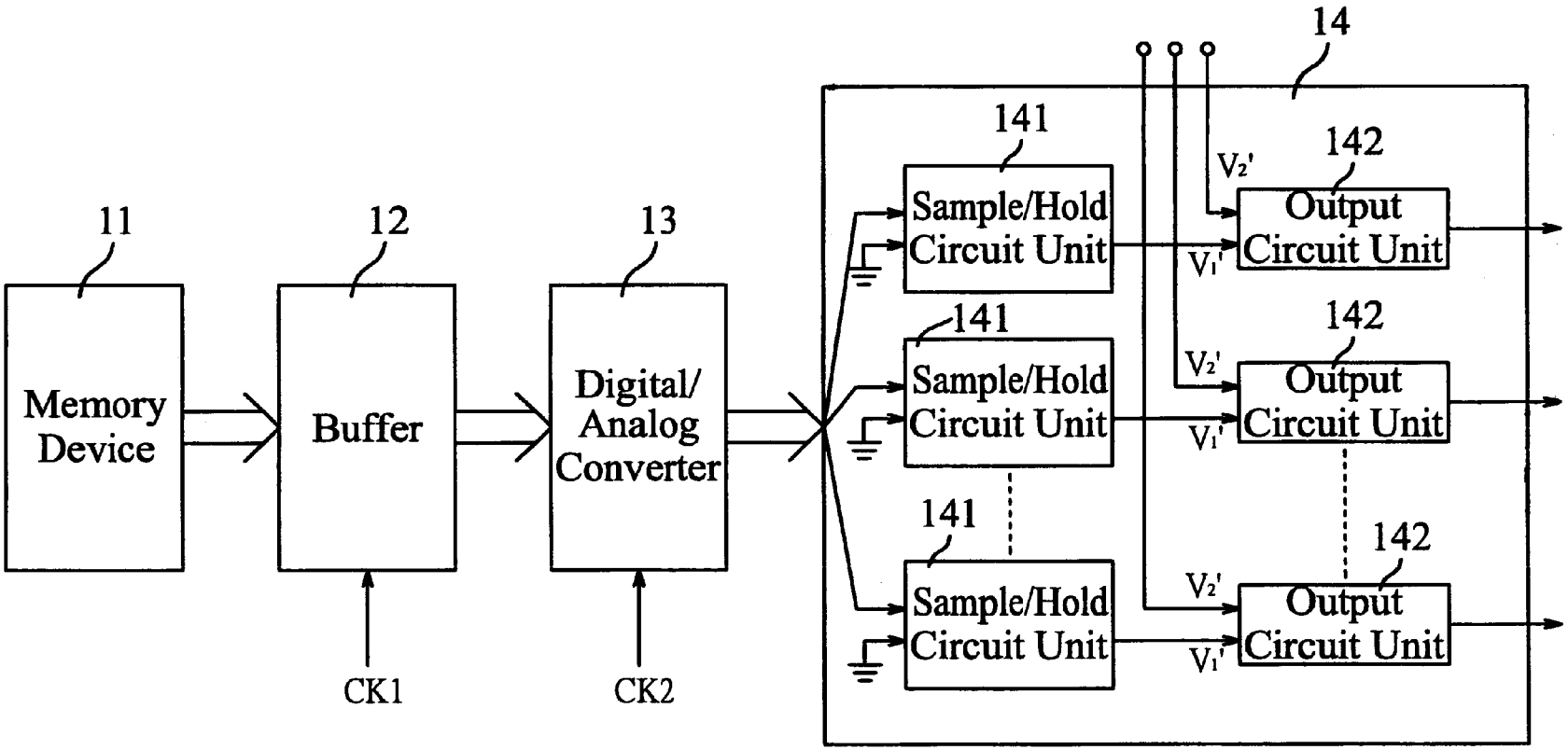
FIG. 1 is a block diagram showing the structure of the compensation circuit for a liquid crystal display according to a preferred embodiment of the invention.

Referring to FIG. 1, it shows the structure of the compensation circuit for a LCD. The LCD consists of multiple pixels arranged in a matrix pattern (m columns × n rows). The compensation circuit includes: a memory device 11, a buffer 12, a digital/analog converter 13 and a data signal line driving circuit 14.

The memory cell 11 can be a Read Only Memory (ROM) for storing the compensation signals for each pixel. The compensation signals consists of m digital data sets each having n digital data. Each of the m digital data sets corresponds to a pixel array of the LCD. Each of the n digital data of the associated digital data set corresponds to a pixel of the corresponding pixel array.

The buffer 12 is connected to the memory device 11 for temporarily store a digital data set coming from the memory device 11 in response to an external clock CK1.

The digital/analog converter 13 is connected to the buffer 12 for converting the digital data set coming from the buffer 12 into an analog data set in response to an external clock CK2.

The data signal line driving circuit 14, consisting of n units each of which is composed of a sample/hold circuit unit 141 and an output circuit unit 142, provides adequate data signals for the n pixels of each pixel array. Each sample/hold circuit unit 141 receives an analog data of the analog data set coming from the digital/analog converter 13 or a ground potential, samples the received data and holds the sampled result. Each output circuit unit 142 receives the output data $V_1'$ coming from the corresponding sample/hold circuit unit 141 and an external signal $V_2'$, outputs the summed result of the two received data to a corresponding pixel.

When flicker is to be compensated, each sample/hold circuit unit 141 receives an analog data of the analog data set coming from the digital/analog converter 13. On the other hand, when flicker is not to be compensated, each sample/hold circuit unit 141 receives a ground potential.

Figure 2:
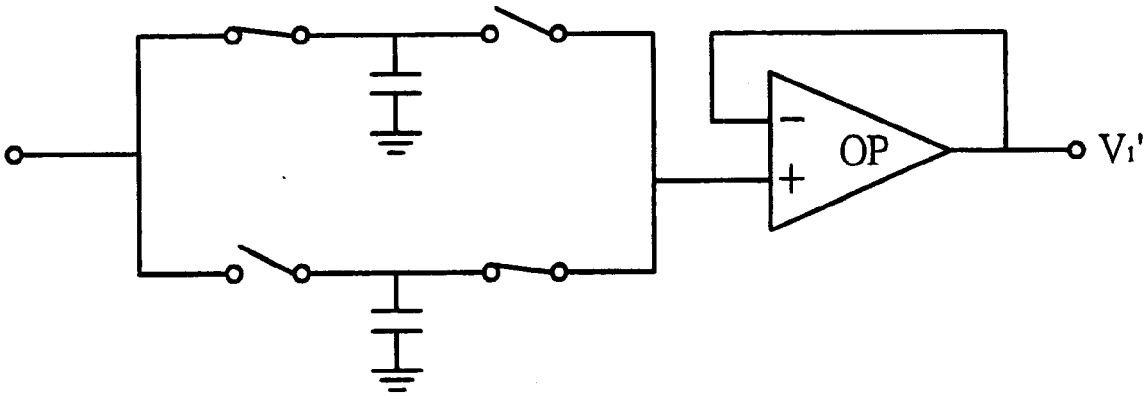
FIG. 2 is a circuit diagram showing the sample/hold circuit unit of FIG. 1.

As described above, the data signal line driving circuit 14 includes n units. Each unit consists of a sample/hold circuit unit 141 and an output circuit unit 142. To prevent current leakage, the sample/hold circuit unit 141 can be implemented by the circuit of FIG. 2. The sample/hold circuit unit 141 selectively receives an analog data of the analog data set coming from the digital/analog converter 13 or a ground potential. The two inputs are selectively provided for the purpose of enabling/disabling the compensation of flicker, which will be described in detail hereinafter.

Figure 3:
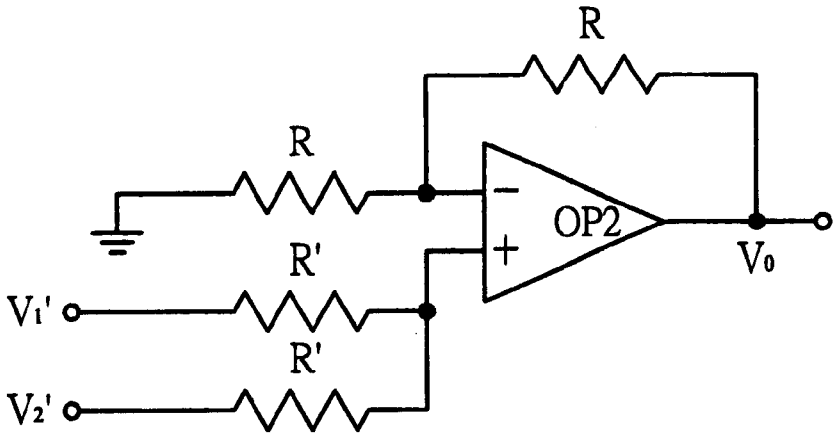
FIG. 3 is a circuit diagram showing the output circuit unit of FIG. 1.

The output circuit unit 142 can be implemented by the circuit of FIG. 3. It consists of an operational amplifier OP2 and 4 resistors. The negative terminal of the operational amplifier OP2 is connected to a ground potential via a resistor having resistance R and connected to the output terminal of the operational amplifier OP2 via another resistor having resistance R. The positive terminal of the operational amplifier OP2 receives the signal $V_1'$ coming from the corresponding sample/hold circuit unit 141 via a resistor having resistance R'. The positive terminal of the operational amplifier OP2 also receives an external DC signal $V_2'$ via another resistor having resistance R'.

The compensation process is performed as follows: (1) computing the output signal $V_0$ of the operational amplifier OP2 by adding $V_1'$ and $V_2'$, i.e. $V_0=V_1'+V_2'$. The external DC signal $V_2'$ represents the original data signal for a pixel. For instance, it can be one of 64-level DC signals. Signal $V_1'$ represents the compensation signal for $V_2'$ and is output from the sample/hold circuit unit 141; (2) enabling/disabling the compensation process by controlling the input of the sample/hold circuit unit 141. When the sample/hold circuit unit 141 receives the analog data coming from the digital/analog converter 13, flicker compensation is enabled. Flicker can be compensated because the digital/analog converter 13 receives the compensation data from the memory device 11. On the other hand, when sample/hold circuit unit 141 receives the ground potential, $V_1'$ will be 0. In other words, $V_0=V_2'$. Compensation process is thus disabled.

Figure 4:
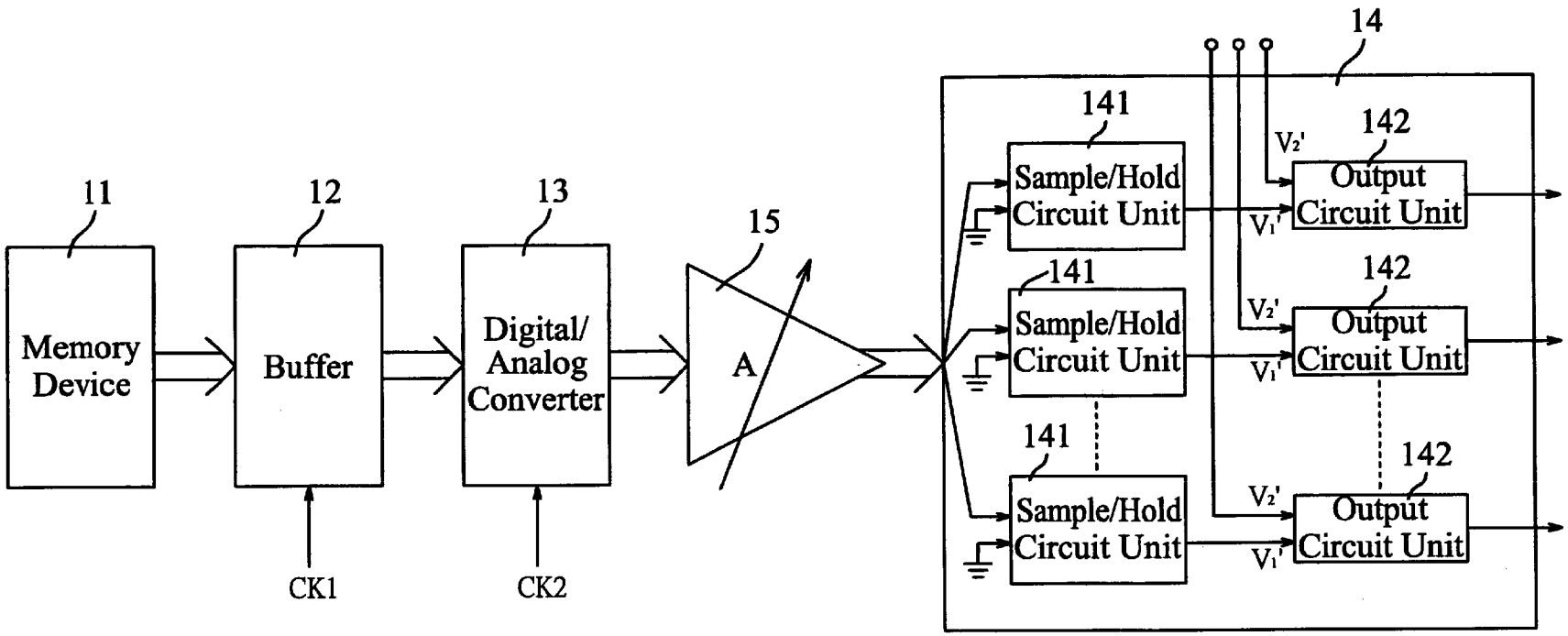
FIG. 4 is a block diagram showing the structure of the compensation circuit for a liquid crystal display according to another preferred embodiment of the invention.
Figure 5A:
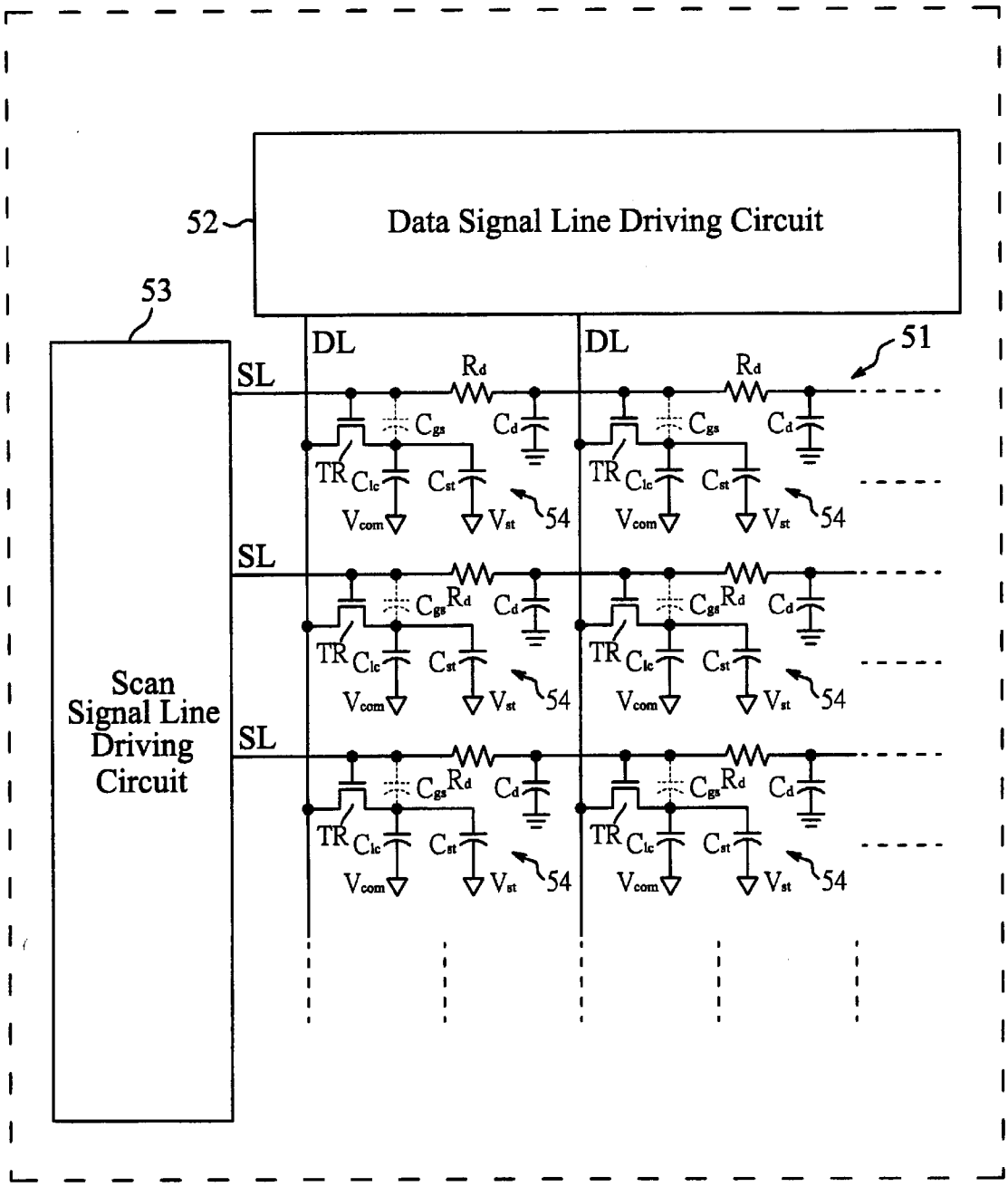
FIG. 5(A) (PRIOR ART)
FIGS. 5(A) and 5(B) show the structure of an active matrix LCD.
Figure 5B:
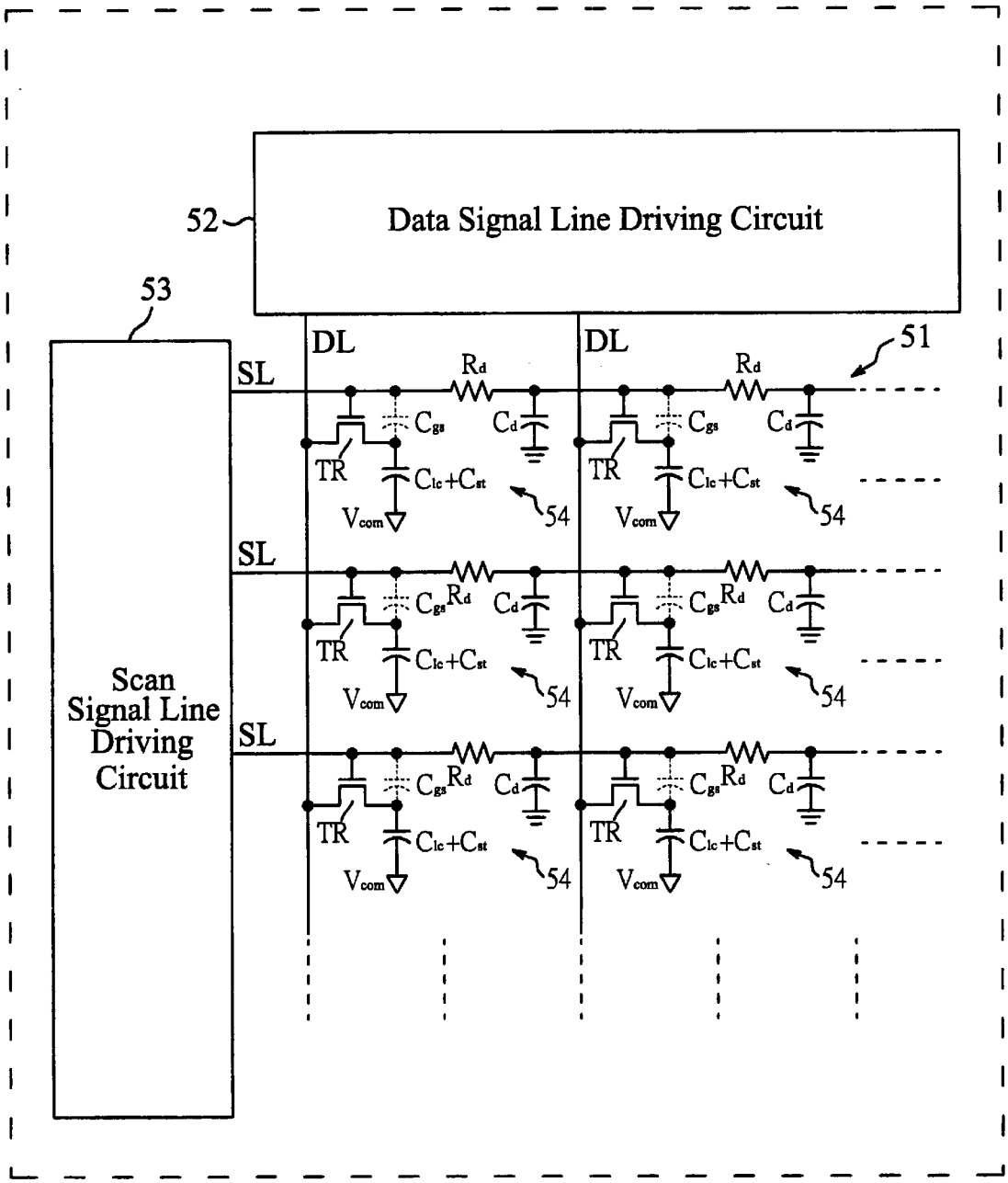
FIG. 5(B) (PRIOR ART)
Figure 6A:
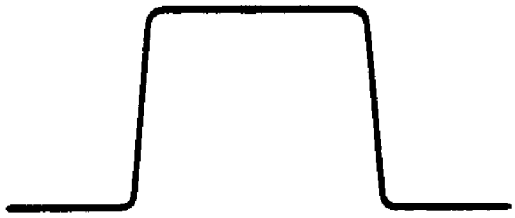
FIG. 6(A) (PRIOR ART)
FIGS. 6(A) and 6(B) are schematic diagrams showing the waveforms generated by the scan signal line driving circuit of FIGS. 5(A) and 5(B).
Figure 6B:
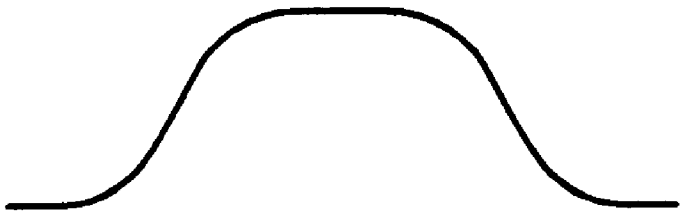
FIG. 6(B) (PRIOR ART)

FIG. 4 illustrates another preferred embodiment of the present invention. The difference between the embodiment of FIG. 1 and that of FIG. 4 is that a gain-adjustable amplifier 15 is added between the digital/analog converter 13 and the data signal line driving circuit 14. The gain-adjustable amplifier 15 can transform the high output impedance of the digital/analog converter 13 into low output impedance.

In the compensation circuit of the invention, each pixel is driven by a thin film transistor. Each unit of the data signal line driving circuit 14 provides an analog data to the drain of the corresponding thin film transistor.

As described in the above, the memory device 11 stores m digital data sets. Each digital data set includes n digital data and corresponds to a pixel array of the LCD. The n digital data of the digital data set correspond to the n pixels in the pixel array and each acts as the compensation signal for the associated pixel. Since the characteristic variation between two pixel arrays is usually little, we can store only the compensation signals for one pixel array unless extremely high image quality is demanded. In other words, we can simply store one digital data set having n digital data in the memory device 11.

It should be understood that various alternatives to the structures described herein may be employed in practicing the present invention. It is intended that the following claims define the invention and that the structure within the scope of these claims and their equivalents be covered thereby.

What is claimed is:

1. A compensation circuit for a liquid crystal display, the liquid crystal display having a plurality of pixels arranged in a matrix pattern consisting of m columns and n rows, comprising:

a memory device for storing m digital data sets each having n digital data, each of said m digital data sets corresponding to a pixel array of the liquid crystal display, said n digital data of each of said m digital data sets corresponding to the n pixels of the associated pixel array and acting as compensation signals for the n pixels;

a buffer connected to said memory device for temporarily storing a digital data set of said memory device in response to a first external clock;

a digital/analog converter connected to said buffer for converting a digital data set consisting of n digital data into an analog data set consisting of n analog data in response to a second external clock; and a data signal line driving circuit for providing a compensation signal for each of n pixels of each pixel array, said data signal line driving circuit having n units each providing a compensation signal for a corresponding pixel, and each unit comprising:

a sample/hold circuit unit which receives an analog data of the analog data set coming from said digital/analog converter or a ground potential, samples the received data and holds the sampled result; and an output circuit unit which receives the output data coming from said sample/hold circuit unit and an external signal, outputs the summed result of the two received data to a corresponding pixel;

wherein flicker compensation can be performed or not as follows: when flicker compensation being to be performed, each of said n sample/hold circuit units of said data signal line driving circuit receives an analog data of an analog data set coming from said digital/analog converter; when flicker compensation being not to be performed, each of said n sample/hold circuit units of said data signal line driving circuit receives a ground potential.

2. The compensation circuit as claimed in claim 1, wherein said each of said output circuit unit of said data signal line driving circuit comprises an operational amplifier and four resistors, the negative terminal of said operational amplifier receives a ground potential via a resistor having a first resistance, and connects to the output terminal of said operational amplifier via a resistor having the first resistance, the positive terminal of said operational amplifier receives the output signal of the corresponding sample/hold circuit unit via a resistor having a second resistance, and receives an external DC signals via a resistor having the second resistance.

3. The compensation circuit as claimed in claim 1, further comprising a gain-adjustable amplifier inserted between said digital/analog converter and said data signal line driving circuit for transforming the high output impedance of said digital/analog converter into low output impedance.

4. The compensation circuit as claimed in claim 1, wherein each pixel is driven by a thin film transistor, each unit of said data signal line driving circuit provides an analog data to the drain of the corresponding thin film transistor.

5. The compensation circuit as claimed in claim 1, wherein said m digital data sets stored in said memory device are the same.

* * * * *